US007331453B2

(12) United States Patent
Burra et al.

(10) Patent No.: US 7,331,453 B2
(45) Date of Patent: Feb. 19, 2008

(54) TRANSPORTATION CASE

(76) Inventors: James P. Burra, c/o 1685 Scenic Ave., Costa Mesa, CA (US) 92626; Susan A. Sherman, c/o 1685 Scenic Ave., Costa Mesa, CA (US) 92626; Carlos A. Castrejon, c/o 1685 Scenic Ave., Costa Mesa, CA (US) 92626

( * ) Notice: Subject to any disclaimer, the term of this patent is extended or adjusted under 35 U.S.C. 154(b) by 699 days.

(21) Appl. No.: 10/098,801

(22) Filed: Mar. 15, 2002

(65) Prior Publication Data

US 2002/0185394 A1 Dec. 12, 2002

Related U.S. Application Data

(60) Provisional application No. 60/296,605, filed on Jun. 7, 2001.

(51) Int. Cl.
*B65D 85/68* (2006.01)
*B65D 19/00* (2006.01)
*B65D 21/00* (2006.01)

(52) U.S. Cl. ..... 206/319; 206/386; 206/503; 206/511

(58) Field of Classification Search ..... 206/319, 206/335, 386, 503, 508, 509, 511; D9/425; 220/669, 671, 674, 675, 1.5; 264/544, 553, 264/571

See application file for complete search history.

(56) References Cited

U.S. PATENT DOCUMENTS 3,005,572 A * 10/1961 Gustafson et al. ..... 220/671
3,244,311 A * 4/1966 Lawson ..... 206/386
3,290,418 A * 12/1966 Best ..... 264/553
3,403,814 A * 10/1968 Asenbauer ..... 206/509
3,438,544 A * 4/1969 Cloyd ..... 206/507
4,371,079 A * 2/1983 Dembicks ..... 206/349
4,678,084 A * 7/1987 Maker et al. ..... 206/511
4,735,310 A * 4/1988 Lemery et al. ..... 206/319
4,890,757 A * 1/1990 Robbins, III ..... 220/675

(Continued)

OTHER PUBLICATIONS

Scribner Plastics, Pro Engine Case [online], Internet Archive date Apr. 24, 1999 [retrieved on Feb. 24, 2005], Retrieved from Internet, <URL: http://www.scribnerplastics.com/engcase.htm>.*

*Primary Examiner*—J. Gregory Pickett
(74) *Attorney, Agent, or Firm*—Wood, Phillips, Katz, Clark & Mortimer

(57) ABSTRACT

A transportation case is provided for an automotive engine, transmission, or the like. The transportation case includes a one-piece molded plastic base and a one-piece molded plastic lid. The base includes a substantial uniform wall thickness and comprises an outer peripheral wall connected to a formed bottom to provide an upwardly opening space. The formed bottom defines a wall for receiving an automotive engine, transmission, or the like, and has opposite longitudinally extending feet for resting on a support surface and a fork lift opening between the feet. The lid includes a substantially uniform wall thickness comprising an outer peripheral wall connected to a top wall. The lid outer peripheral wall is received on the base outer peripheral wall to close the upwardly opening space. At least one of the base and lid includes plural vertically extending semi-circular stiffening ribs enabling plural transportation cases to be stacked with feet of one transportation case being supported on the top wall of another transportation case.

21 Claims, 6 Drawing Sheets

U.S. PATENT DOCUMENTS 5,011,011 A * 4/1991 Kidd ..... 206/319
5,566,624 A * 10/1996 Brown et al. ..... 108/901
D439,514 S * 3/2001 Burra ..... D9/425

* cited by examiner

TRANSPORTATION CASE

CROSS-REFERENCE

This application claims priority of application No. 60/296,605 filed Jun. 7, 2001.

FIELD OF THE INVENTION

This invention relates to a transportation case for an automotive engine, transmission, or the like, and more particularly, to a transportation case adapted to enable plural transportation cases to be stacked.

BACKGROUND OF THE INVENTION

Transportation cases, also known as engine cases, have been used for transporting automotive engines, transmissions, or the like, for service. Typically, the transportation cases are of two-piece construction, including a base and a lid. Both the base and the lid are of molded plastic construction. Often, an insert rests at the bottom of the base and is adapted to support a particular model engine or transmission.

As is known, a typical automotive engine or transmission is very heavy. Known transportation cases are properly configured to enclose and transport an engine or transmission. Particularly, the base is designed to structurally support the engine or transmission. The lid is provided to enclose the interior space but it is not intended as a structural component. As such, the conventional transportation cases allow stacking only to a limited degree. Thus, floor space or truck space must be provided for storing or transporting each individual transportation case.

The present invention is directed to improvements in transportation cases.

SUMMARY OF THE INVENTION

In accordance with the invention, there is provided a transportation case adapted to enable stacking.

Broadly, a transportation case is provided for an automotive engine, transmission, or the like. The transportation case includes a one-piece molded plastic base and a one-piece molded plastic lid. The base includes a substantial uniform wall thickness and comprises an outer peripheral wall connected to a formed bottom to provide an upwardly opening space. The formed bottom defines a wall for receiving an automotive engine, transmission, or the like, and has opposite longitudinally extending feet for resting on a support surface and a fork lift opening between the feet. The lid includes a substantially uniform wall thickness comprising an outer peripheral wall connected to a top wall. The lid outer peripheral wall is received on the base outer peripheral wall to close the upwardly opening space. At least one of the base and lid includes plural vertically extending semicircular stiffening ribs enabling plural transportation cases to be stacked with feet of one transportation case being supported on the top wall of another transportation case.

Further features and advantages of the invention will be readily apparent from the specification and from the drawings.

DETAILED DESCRIPTION OF THE INVENTION

Figure 1:
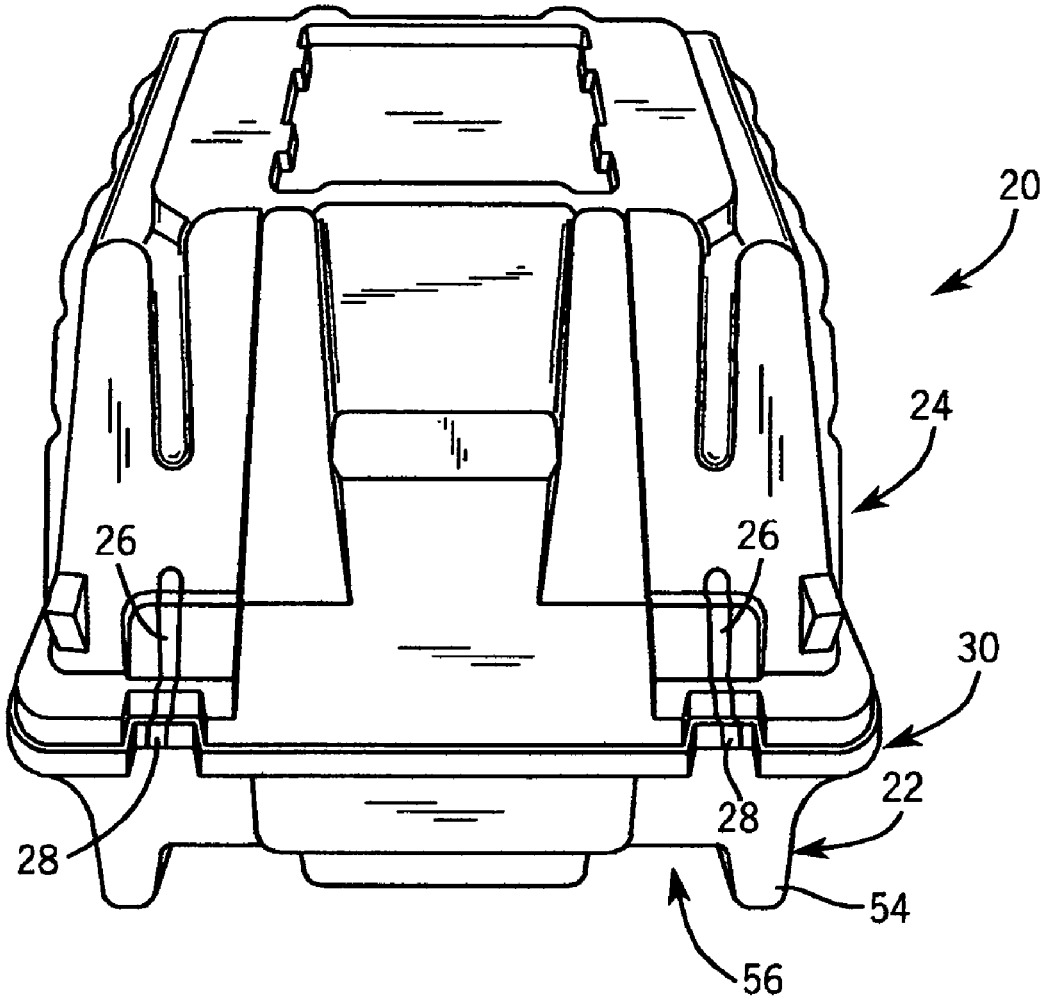
FIG. 1 is a perspective view of a transportation case in accordance with the invention.
Figure 2:
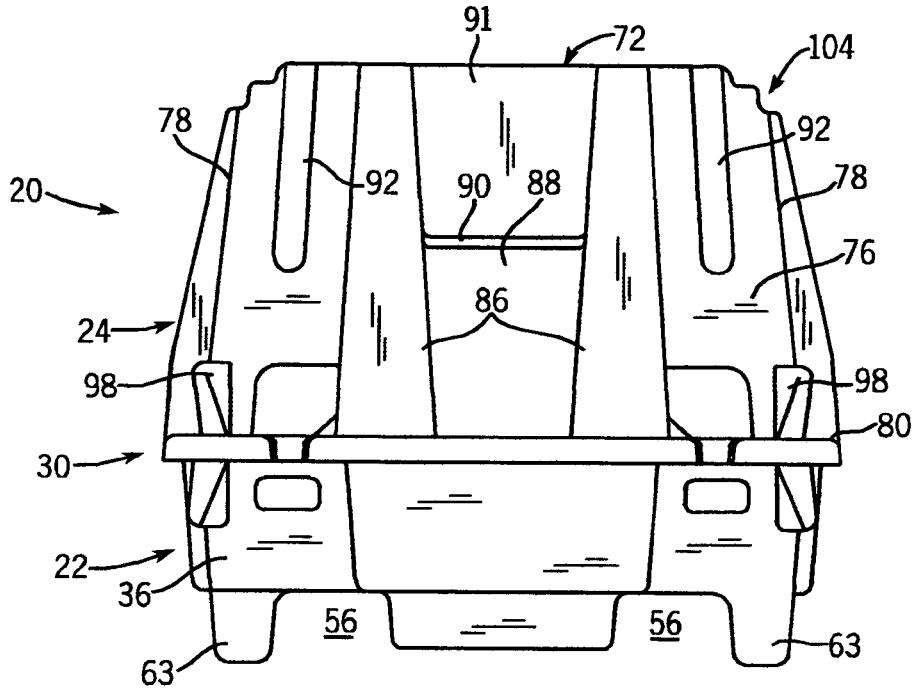
FIG. 2 is a front elevation view of the transportation case of FIG. 1.
Figure 3:
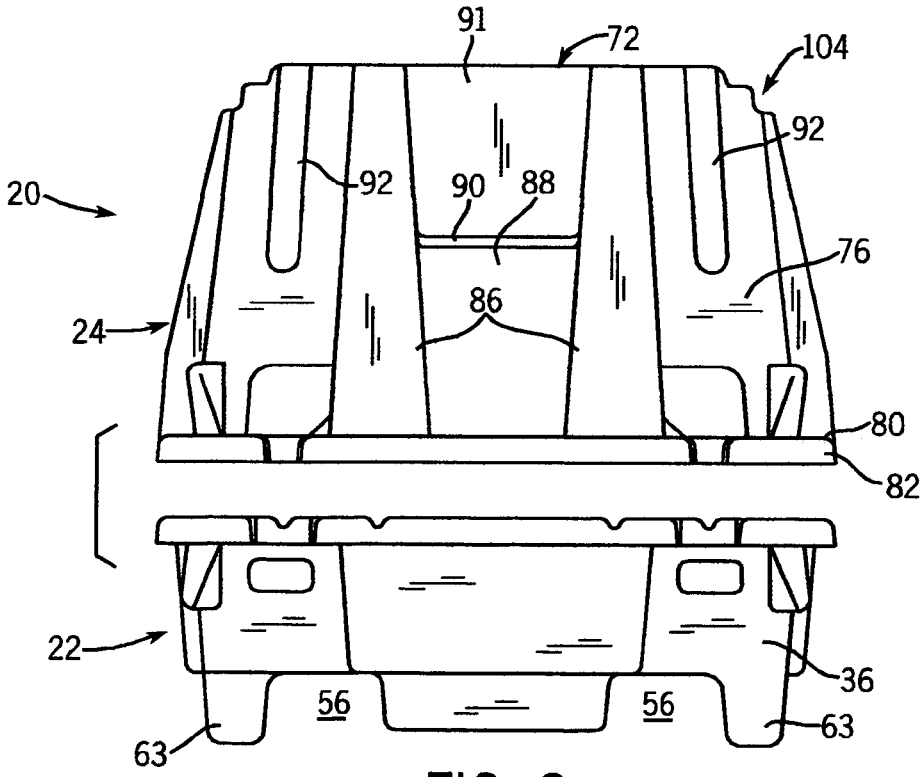
FIG. 3 is a front elevation view, similar to FIG. 2, with a lid partially removed from a base.
Figure 4:
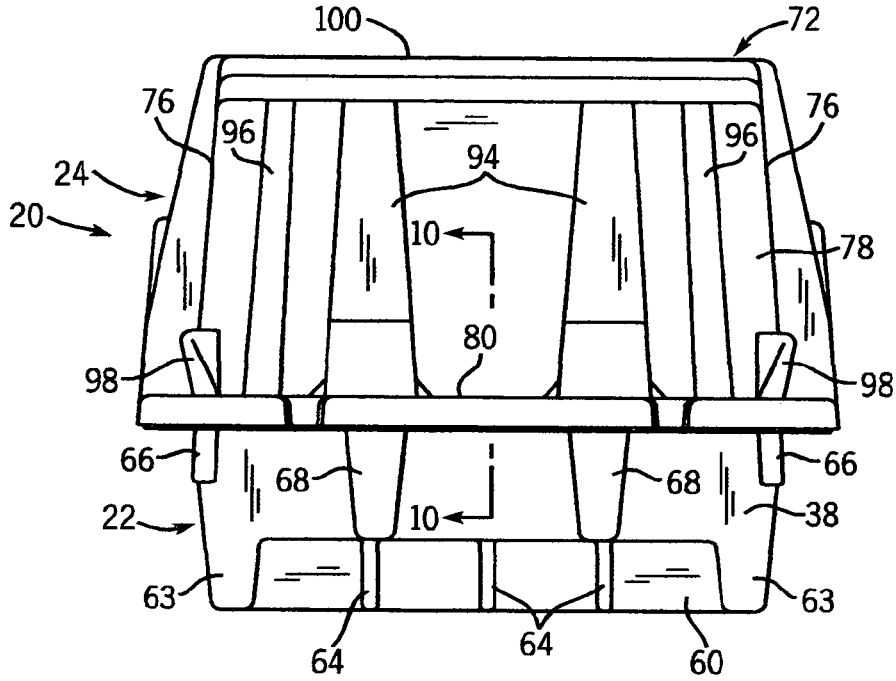
FIG. 4 is a side elevation view of the transportation case of FIG. 1.
Figure 5:
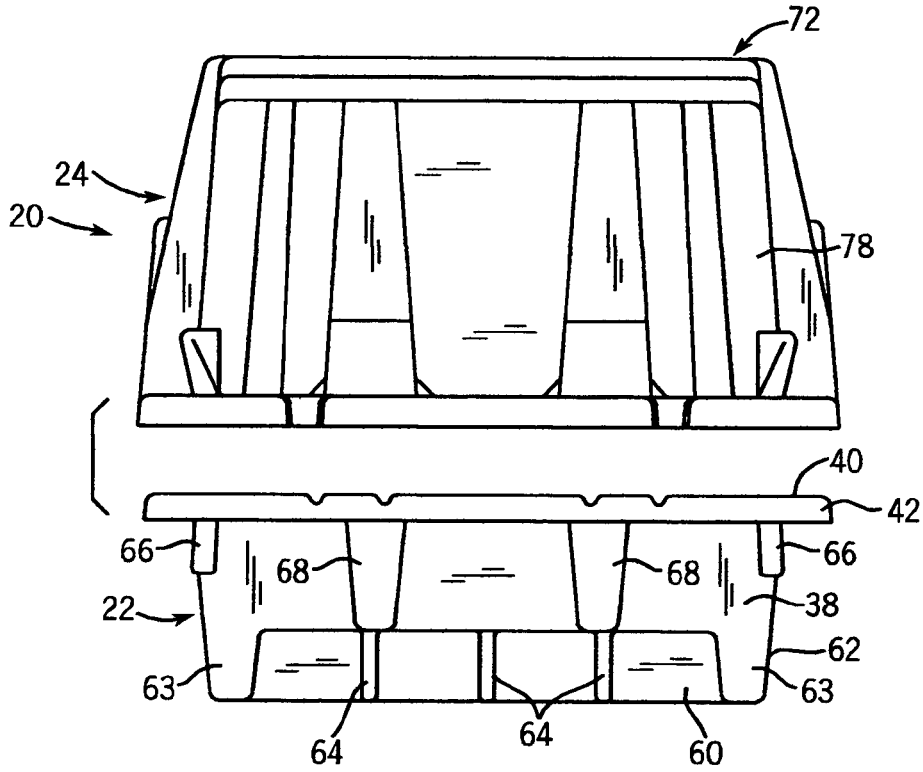
FIG. 5 is a side elevation view, similar to FIG. 4, with the lid partially removed from the base.

Referring to FIGS. 1-5, a two-piece transportation case 20 in accordance with the invention is illustrated. The transportation case 20 is adapted for storing and transporting automotive engines, transmissions, or the like. Particularly, the transportation case 20 is adapted to enable plural of the transportation cases 20 to be stacked atop one another. Particularly, the transportation case 20 while mounted on a floor or other support surface can hold the weight of about 1,800 pounds above the case. Thus, the total weight including the weight in the bottom most case 20 is about 2,400 pounds. This allows the transportation case 20 to be used to stack heavy automotive engines or transmissions, and the like, thus saving floor space and truck space.

The transportation case 20 includes a one-piece molded plastic base 22 and a one-piece molded plastic lid 24. Rubber straps 26 are secured to the lid 24. The straps 26 include hooks 28 that pull over a lip of the base 22 to removably secure the lid 24 on the base 22 in a conventional manner.

The base 22 and lid 24 are each vacuum formed from sheets of high molecular weight polyethylene. Thus, the case 20 is impervious to oils, most chemicals, rot, solvents and temperature extremes. Vacuum forming produces a stress-free case with maximum resistance to cracking from impact and other environmental conditions. Because each of the base 22 and lids 24 is formed from a sheet of high density polyethylene, each has a substantial uniform wall thickness throughout. As is apparent, there may be slight differences in wall thickness. In an illustrative embodiment of the invention, the lid 24 and the base 22 are drawn from polyethylene sheets to a wall thickness that is slightly greater than one quarter inch substantially throughout.

The transportation case 20 is of a generally parallelepiped configuration with an approximate five degree draft to enable nesting and to enhance moldability of the lid 24 and the base 22 during vacuum forming. The outside dimension of the transportation case 20 where the base 22 and lid 24 join, reference generally at 30, is approximately 32 inches by 37 inches. The height of the case 20 is about 29 inches.

Figure 6:
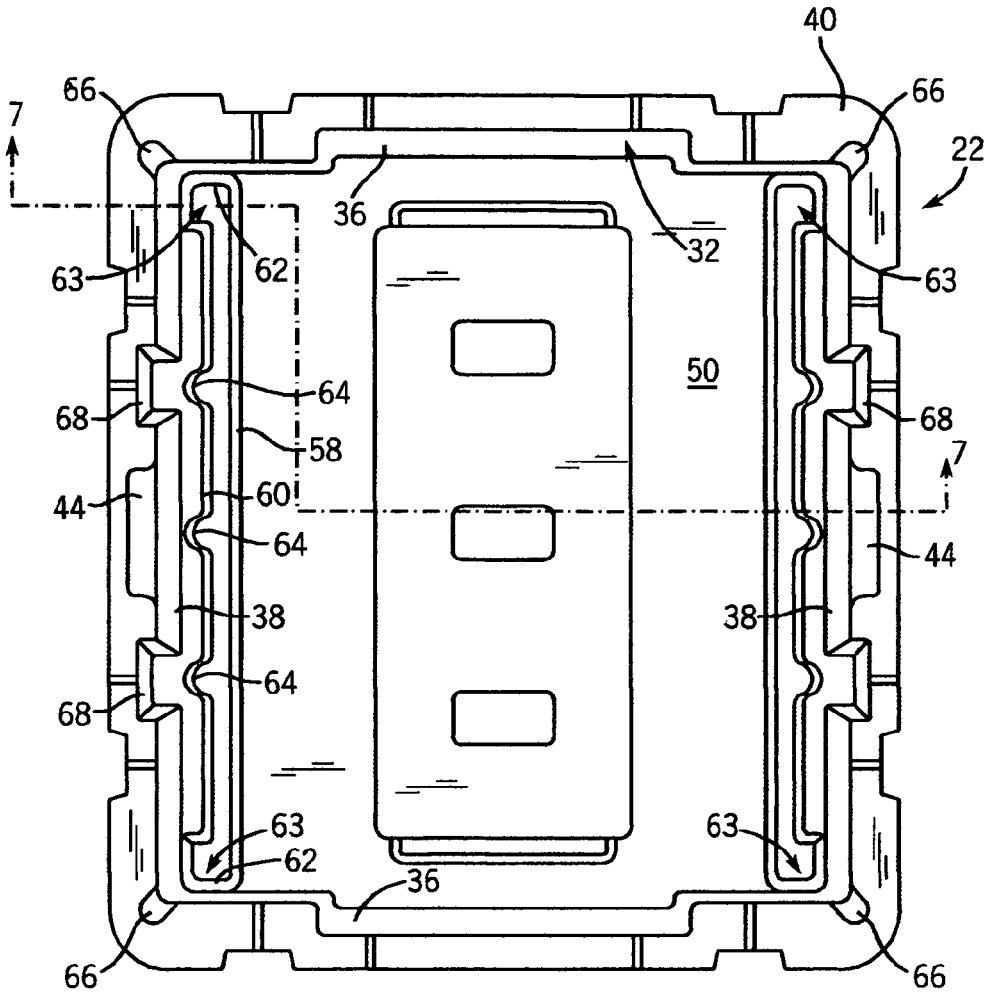
FIG. 6 is a plan view of the base.
Figure 7:
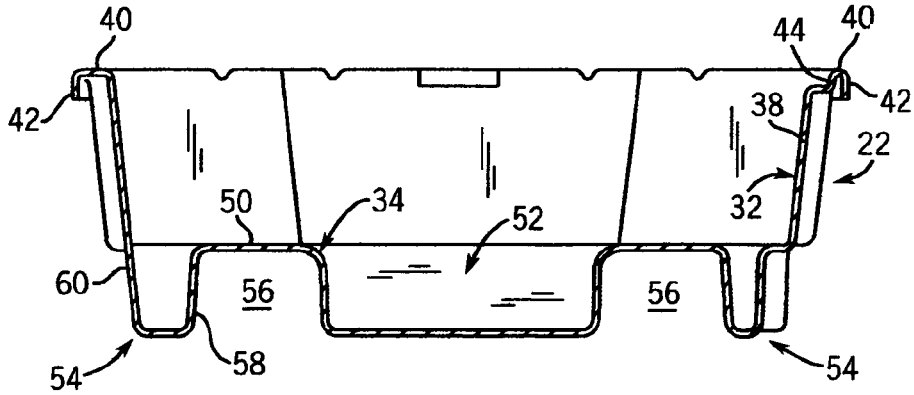
FIG. 7 is a sectional view taken along the line 7-7 of FIG. 6.

Referring also to FIGS. 6 and 7, the base 22 comprises an outer peripheral wall 32 connected to a formed bottom 34. The outer peripheral wall 32 is generally rectangular and has opposite transversely extending end walls 36 connected between opposite longitudinally extending side walls 38. The upper edge of the peripheral wall 32 is turned outwardly to define a flange 40 which is then turned downwardly to provide an outer lip 42. The longitudinally extending side walls 38 are notched as at 44 at a mid-point, by the flange 40, for engaging the lid 24, as described below.

The formed bottom 34 includes a bottom wall 50 having a longitudinally extending well 52 disposed between opposite elongate feet 54. Although not shown, an automobile engine or transmission, or the like, can be supported on the bottom wall 50, with a pan extending into the well 52, or can be supported on a removable insert. The removable insert may be similar to that shown in U.S. Design Pat. No. 440,042, assigned to the assignee of the present application, the specification of which is hereby incorporated by reference herein. Longitudinally extending spaces 56 between the well 52 and the opposite feet 54 are adapted to receive tines of a fork lift (not shown).

Each of the feet 54 extends the full length of the base 22. Each foot 54 includes an inner wall 58 closest to the well 52 and an outer wall 60. The inner wall 58 is substantially planar. The inner wall 58 and outer wall 60 are connected at opposite end walls 62. The outer wall 60 is wider proximate at the end wall 62 to define corners 63. Three vertically extended semi-circular stiffening ribs 64 extend the height of the feet outer wall 60 approximately equal distance between the corners 63. The stiffener ribs 64 comprises concave ribs. The ribs 64 have a radius of less than one inch and advantageously about 0.75 inches. The stiffening ribs 64 are configured as concave or male stiffeners.

The peripheral side wall 32 includes a stacking lug 66 at each junction of the flange 40. The stacking lugs 66 prevent jamming when bases 22 are nested. Additionally, the transversely extending side walls 38 include a pair of trapezoidal ribs 68 extending from the flange 40 to the formed bottom 34. While the trapezoidal ribs 68 provide stiffness to the base 22, the stiffening ribs 64, owing to the radius configuration in a vacuumed form structure, provide substantially improved strength to enable stacking, as described below.

Figure 8:
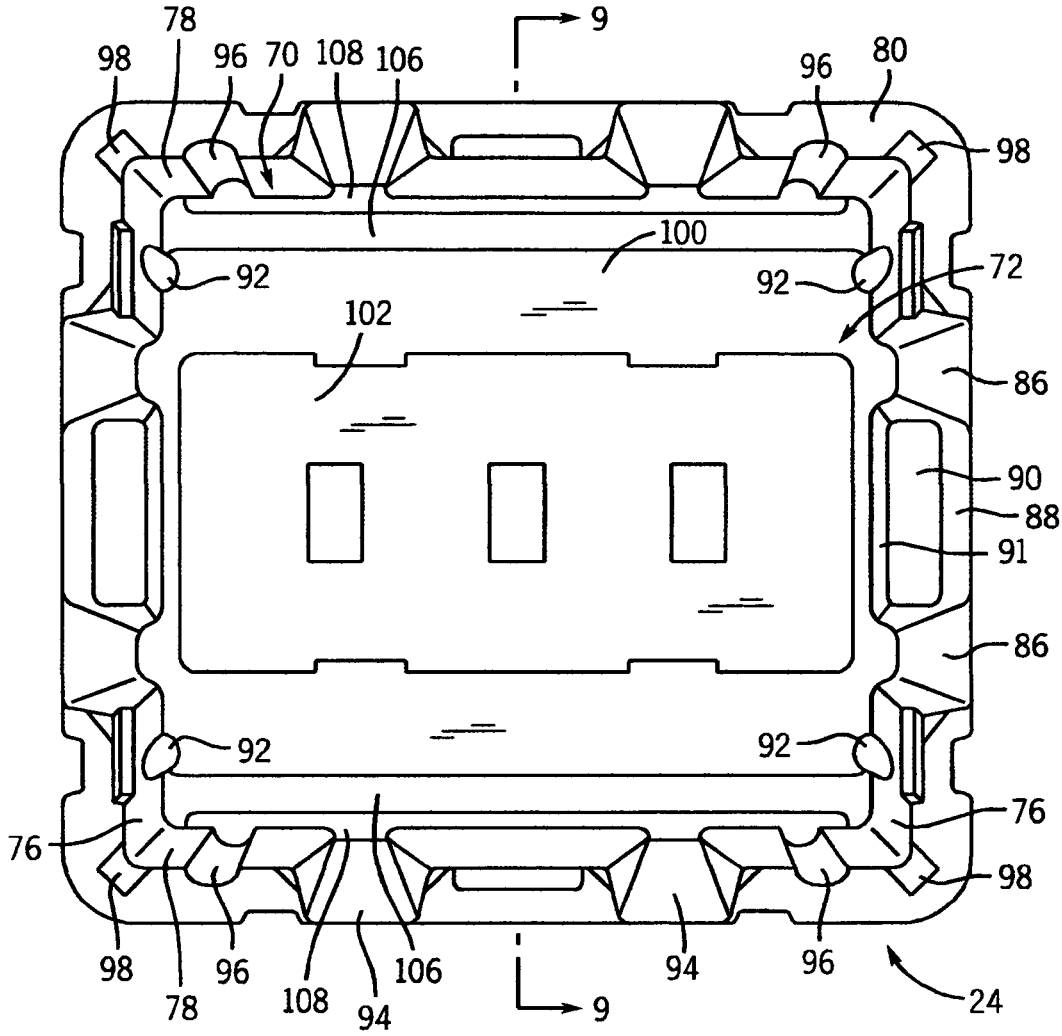
FIG. 8 is a plan view of the lid.
Figure 9:
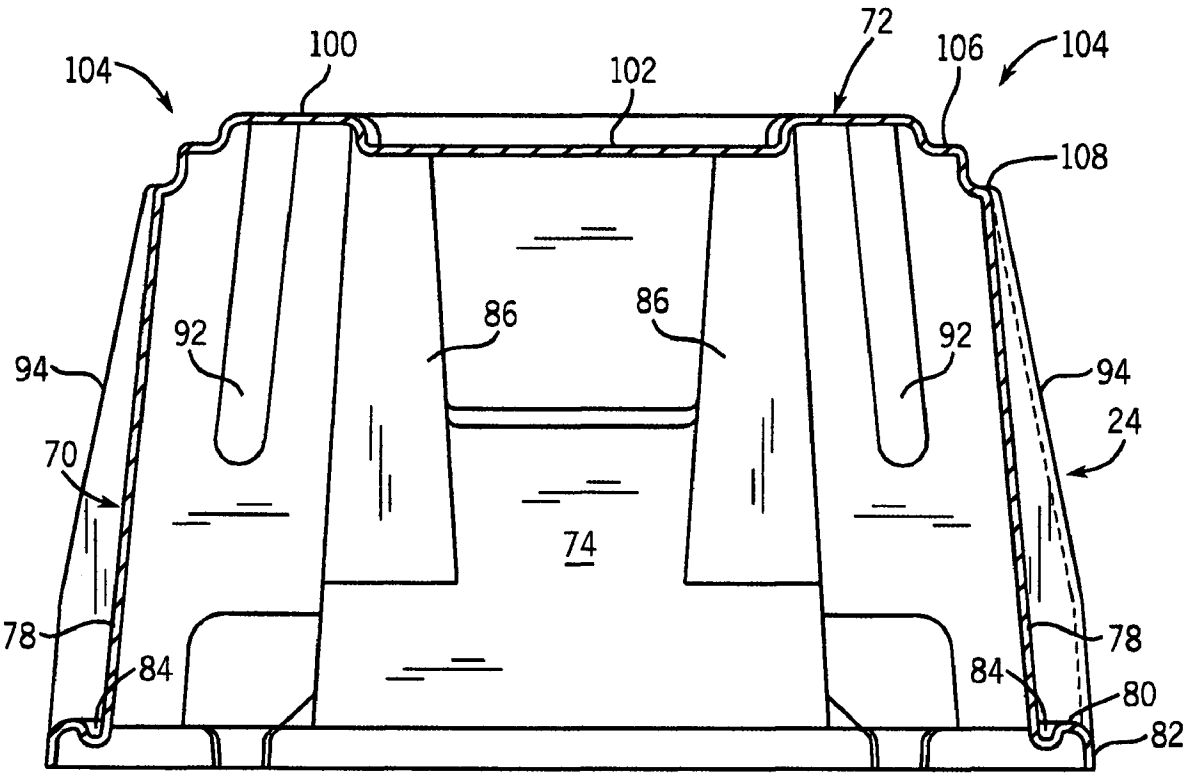
FIG. 9 is a sectional view taken along the line 9-9 of FIG. 8.

Referring also to FIGS. 8 and 9, the lid 24 includes an outer peripheral side wall 70 connected to a formed top 72 to define a downwardly opening space 74, see FIG. 9.

Figure 10:
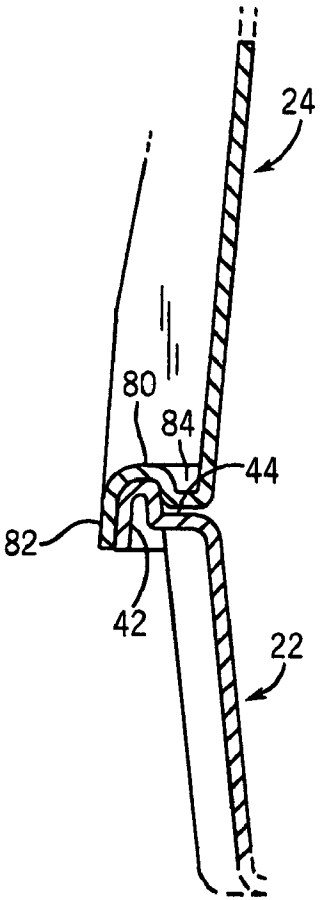
FIG. 10 is a sectional view taken along the line 10-10 of FIG. 4.

Particularly, the outer peripheral side wall 70 includes opposite transversely extending end walls 76 connected between opposite longitudinally extending side walls 78. A peripheral flange 80 extends outwardly from the bottom of the peripheral side wall 70. The flange 80 is turned downwardly to form a lip 82. As such, the lid flange 80 is sized to be received on the base flange 40 with the downwardly extending lip 82 surrounding the base lip 42. Similarly, at central locations of the side walls 78, the flange 80 includes wells 84 received in the base notches 44, as shown particularly in FIG. 10.

The end walls 76 include trapezoidal ribs 86 extending from the flange 80 to the top 72. Between the trapezoidal ribs 86, the end wall 76 extends vertically as at 88 and is connected via a ledge 90 to an inner vertical wall 91 which is in turn connected to the top 72, as particularly illustrated in FIG. 2. A pair of concave semi-circular stiffener ribs 92 are located in each end wall 76. Each rib 92 is between one of the trapezoidal ribs 86 and the adjacent side wall 78. The stiffening ribs 92 extend downwardly from adjacent the top 72 approximately half way down the end wall 76. The semi-circular ribs have a radius of less than one inch and advantageously about 0.75 inches.

The side walls 78 include trapezoidal ribs 94 extending upwardly from the flange 80 to the top 72. Disposed between each trapezoidal rib 94 and the adjacent end wall 76 is a male or concave semi-circular stiffening rib 96. The stiffening ribs 96 extend the entire height of the side wall 78 from the flange 80 to the top 72. The semi-circular ribs 96 have a radius of less than one inch and advantageously about 0.75 inches. Stacking lugs 98 are included at the juncture between each side wall 78 and end wall 76 proximate the flange 80.

The formed top 72 includes a generally rectangular top wall 100 having a generally rectangular centrally located well 102. The top wall 100 is connected to an upper edge of the end walls 76. The top wall is doubled stepped at 104 where it connects to the side wall 78. Particularly, the double step connection provides a first or uppermost horizontal ledge 106 and a second or lowermost horizontal ledge 108. The first ledge 106 is wider than the second ledge 108, as can be seen in FIG. 8. The first ledge 106 is adapted to receive the feet 54 of the base 22 of an upper transportation case 20 for stacking purposes. The well 102 provides room for a base well 52 to be received therein when stacking. Particularly, the height of the well 102 corresponds to the height of the first ledge 106, as can be seen in FIG. 9.

In use, an engine or transmission is placed in the base 22 resting on the bottom wall 50. If the engine or transmission includes a pan, then it will extend into the well 52. Typically, an insert is used with such a pan engine, as discussed above. The lid 24 is then placed atop of the base and can be secured with the hooks 28, see FIG. 1. Multiple transportation cases 20 can be stacked for shipping and storage. Particularly, the use of the four concave ribs 92 on the end wall 76, the four convex ribs 96 on the side wall 78, the double step sides 104 and the six convex ribs 64 on the feet 54 enable the transportation in case 20 to support as much as 1,800 pounds on the lid 24 when stacked. Additionally, the tall, narrow lips 42 and 82 on the base 22 and lid 24, respectively, are trimmed vertically.

Thus, in accordance with the invention, there is described a transportation case which can hold a variety of automotive engines and transmissions and can be stacked and hold a weight of as much as 1,800 pounds. This saves floor space and truck space.

We claim:

1. A transportation case for an automotive engine, transmission, or the like, comprising:

a one-piece molded plastic base including a substantially uniform wall thickness, comprising an outer peripheral wall connected to a formed bottom to provide an upwardly opening space, the formed bottom defining a wall for receiving an automotive engine, transmission, or the like, and having opposite longitudinally extending feet for resting on a support surface and a forklift opening between the feet;

a one-piece molded plastic lid including a substantially uniform wall thickness comprising an outer peripheral wall connected to a top wall, the lid outer peripheral wall being received on the base outer peripheral wall to close the upwardly opening space;

at least one of the base and lid including plural vertically extending semi-circular stiffening ribs enabling plural transportation cases to be stacked with feet of one transportation case being supported on a top wall of another transportation case.

2. The transportation case of claim 1 wherein the semi-circular stiffening ribs have a radius of less than one inch.

3. The transportation case of claim 1 wherein the semi-circular stiffening ribs have a radius of about three-fourths of an inch.

4. The transportation case of claim 1 wherein the semi-circular stiffening ribs comprise concave ribs.

5. The transportation case of claim 1 wherein the semi-circular stiffening ribs comprise convex ribs.

6. The transportation case of claim 1 wherein the lid and base are generally rectangular and longitudinally extending side walls of the lid outer peripheral wall each include two of the stiffening ribs.

7. The transportation case of claim 6 wherein the two stiffening ribs in the longitudinally extending side walls extend substantially an entire height of the side walls.

8. The transportation case of claim 1 wherein the lid and base are generally rectangular and transversely extending side walls of the lid outer peripheral wall each include two of the stiffening ribs.

9. The transportation case of claim 8 wherein the two stiffening ribs in the transversely extending side walls extend about half of an entire height of the side walls.

10. The transportation case of claim 1 wherein the stiffening ribs are formed in the longitudinally extending feet.

11. The transportation case of claim 1 wherein the lid and base are generally rectangular and longitudinally extending side walls of the lid outer peripheral wall each include two of the stiffening ribs and transversely extending side walls of the lid outer peripheral wall each include two of the stiffening ribs.

12. The transportation case of claim 11 wherein the two stiffening ribs in the longitudinally extending side walls are convex and extend substantially an entire height of the longitudinally extending side walls and the two stiffening ribs in the transversely extending side walls are concave and extend about half of the entire height of the transversely extending side walls.

13. A generally parallelepiped transportation case for an automotive engine, transmission, or the like, comprising:

a one-piece molded plastic base including a substantially uniform wall thickness, comprising a generally rectangular outer peripheral wall connected to a formed bottom to provide an upwardly opening space, the formed bottom defining a wall for receiving an automotive engine, transmission, or the like, and having opposite longitudinally extending feet for resting on a support surface and a forklift opening between the feet, the feet including plural vertically extending semi-circular stiffening ribs;

a one-piece molded plastic lid including a substantially uniform wall thickness comprising a generally rectangular outer peripheral wall connected to a top wall, the lid outer peripheral wall being received on the base outer peripheral wall to close the upwardly opening space, the peripheral wall including plural vertically extending semi-circular stiffening ribs;

the vertically extending semi-circular stiffening ribs enabling plural transportation cases to be stacked with feet of one transportation case being supported on a top wall of another transportation case.

14. The transportation case of claim 13 wherein the semi-circular stiffening ribs have a radius of less than one inch.

15. The transportation case of claim 13 wherein the semi-circular stiffening ribs have a radius of about three-fourths of an inch.

16. The transportation case of claim 13 wherein longitudinally extending side walls of the lid outer peripheral wall each include two of the stiffening ribs.

17. The transportation case of claim 16 wherein the two stiffening ribs in the longitudinally extending side walls extend substantially an entire height of the side walls.

18. The transportation case of claim 13 wherein transversely extending side walls of the lid outer peripheral wall each include two of the stiffening ribs.

19. The transportation case of claim 18 wherein the two stiffening ribs in the transversely extending side walls extend about half of an entire height of the side walls.

20. The transportation case of claim 13 wherein longitudinally extending side walls of the lid outer peripheral wall each include two of the stiffening ribs and transversely extending side walls of the lid outer peripheral wall each include two of the stiffening ribs.

21. The transportation case of claim 20 wherein the two stiffening ribs in the longitudinally extending side walls are convex and extend substantially an entire height of the longitudinally extending side walls and the two stiffening ribs in the transversely extending side walls are concave and extend about half of the entire height of the transversely extending side walls.

* * * * *